United States Patent [19]

Matas Gabalda

[11] Patent Number: 4,693,068

[45] Date of Patent: Sep. 15, 1987

[54] THREAD SLACKENING DEVICE

[75] Inventor: Carlos Matas Gabalda, Granges les Valence, France

[73] Assignee: I.C. ACBF, France

[21] Appl. No.: 870,998

[22] Filed: Jun. 5, 1986

[30] Foreign Application Priority Data

Jun. 11, 1985 [FR] France ..... 85 08987

[51] Int. Cl.[4] ..... D01H 13/10; B65H 59/00

[52] U.S. Cl. ..... 57/58.86; 57/352; 242/147 R; 242/150 R

[58] Field of Search ..... 57/58.86, 58.52, 58.7, 57/352; 242/131, 131.1, 150 M, 147 R, 149, 150 R, 156.2

[56] References Cited

U.S. PATENT DOCUMENTS

| | | | |
|---|---|---|---|
| 2,177,039 | 10/1939 | Houck . | |
| 3,359,716 | 12/1967 | Klein . | |
| 3,525,205 | 8/1970 | Antoni et al. . | |
| 3,830,051 | 8/1974 | Veltges | 57/58.86 X |
| 4,237,683 | 12/1980 | Mathiolon et al. | 57/58.86 |
| 4,462,557 | 7/1984 | Warner | 242/147 R X |
| 4,592,195 | 6/1986 | Charbonnier | 57/58.86 X |

FOREIGN PATENT DOCUMENTS

| | | |
|---|---|---|
| 2268884 | 11/1975 | France . |
| 2430991 | 2/1980 | France . |

*Primary Examiner*—Donald Watkins

*Attorney, Agent, or Firm*—Parkhurst & Oliff

[57] ABSTRACT

Device for regulating the tension of a thread through the different transformation operations to which said thread is subjected during its manufacture, said device being of the type forming an assembly comprising cups between which passes the thread, said cups being mounted on a hub and locked in position one against the other by way of a nut, and said hub being mounted on a rotary shaft which is common to all the positions of one face of the machine, device wherein: the cups are mounted in pairs on either side of a cylindrical track which is fast in rotation with said cups, said track having a diameter at least equal to the diameter of the circle of contact between the two cups, and said thread being, while thrown, in contact with the central cylindrical track, and after throwing, pushed back onto the side tracks constituted by each pair of cups in order to be placed in the normal working conditions after throwing; and the nuts holding each pair of cups one against the other enable a variation of their pressure, hence an adjustment of the tension which is communicated to the thread.

4 Claims, 4 Drawing Figures

THREAD SLACKENING DEVICE

Figure 1:
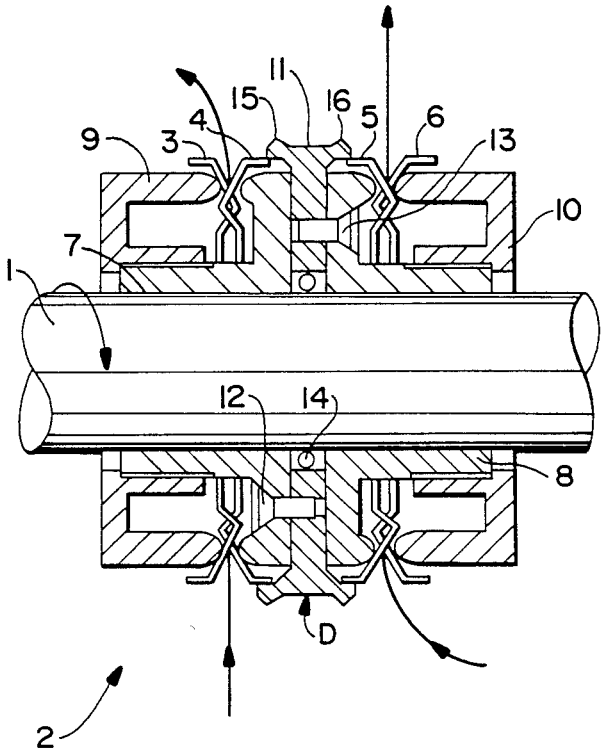

The manufacture of threads for use in weaving, knitting, etc . . . , whether these threads are of natural, artificial or synthetic origin, involves a number of operations (twisting, drawing, heat treatment, etc . . .) during which the material has to be kept under a very specific tension. It is sometimes necessary to vary the tension of the thread during its treatment, and for example to reduce said tension upstream of the winding member, as it is wellknown that when a thread is wound on a bobbin while in a very stretched condition and without any special precautions, the resulting bobbins are very hard, and unwinding is nearly impossible. To this effect, and as described for example in French Pat. No. 2 268 884, a device known as "yarn slackening device" or an "overspeed delivery member" is introduced between the last lappet and the thread guide of the winding member, said device causing the feeding of the thread by sliding and pulling said thread at a speed greater than the normal feeding speed. It is possible with such a device to automatically obtain, as a function of the variations occurring in the thread pulling speed, a self-adjustment of the tension at the output of the slackening member, said tension being kept to a very low value. It is used, not only in those installations where a twist is communicated to the thread and which comprise a double twist spindle (FR-A No. 2 268 884), but also in installations where a plurality of treatments are conducted either simultaneously or continuously, such as for example twisting installations conducting single- or double-twist operations where the thread goes through a heat treatment before being wound (FR-A No. 2 430 991, U.S. Pat. No. 3 525 205, etc . . .). The thread slackeners proposed heretofore are, generally speaking, in the form of a rotary device constituted by two cups between which passes the thread. Said cups are mounted on a hub and are locked in position one against the other normally by a nut permitting the adjustment of their pressure, hence of the tension which they cause to be communicated to the thread. Said hub is frictionally mounted on a rotary shaft which is common to all the positions of one face of the machine. To slacken the thread, it is essential that the speed of said device be higher than the thread feeding speed, so that the thread will tend to rest on the cups by passing around an arc of circle.

This particular type of device is very widely used at the moment, nevertheless it has the disadvantage of raising problems when the threads are thrown, as these threads can get caught in the delivery members during the different operations which are required to this effect. Also, until now such slackening devices could only be used for one thread and only permit one slackening action to be conducted on the path of the thread.

It has now been found, and this is the object of the present invention, that said thread slackening device can be improved in such a way as to facilitate the thread-throwing operations, and also to work on two threads in parallel or to carry out two successive slackening operations on the path of one thread.

In general, the device according to the invention for regulating the tension of a thread during the different transformation operations undergone by that thread during its manufacture (which device is designated hereinafter as a slackener), is in the form of an assembly comprising cups between which passes the thread, said cups being mounted on a hub and locked in position one against the other by way of a nut, and said hub being mounted on a rotary shaft which is common to all the positions of one face of the machine, device wherein:

the cups are mounted in pairs on either side of a cylindrical track which is fast in rotation with said cups, said track having a diameter at least equal to the diameter of the circle of contact between the two cups, and said thread being, while thrown, in contact with the central cylindrical track, and after throwing, pushed back onto the side tracks constituted by each pair of cups in order to be placed in the normal working conditions after throwing;

the nuts holding each pair of cups one against the other enable a variation of their pressure, hence an adjustment of the tension which is communicated to the thread.

With such a device, it is possible, either to treat two threads in two adjacent positions, the central cylindrical track being used for throwing the thread, and each thread being pushed back on the two side tracks constituted by the pairs of cup-like members after the start of the operation, or to carry out two successive slackening operations on the path of one thread.

According to one embodiment of the invention, the cylindrical central track is constituted by a part interposed between the two hubs, and is held in position by a screw, the drive through the driving shaft being transmitted via a joint; in such a case, said track has a diameter which is greater than the outer diameter of the cups and comprises two peripheral flanges for supporting the thread or threads during the throwing operation.

According to another embodiment of the invention, the central track is formed in the hub proper, forming an integral part thereof, and its outer diameter is less than the diameter of the lateral rims of the cup members, thus ensuring the positioning and support of the thread or threads when these are in contact with said central track and acting as a ramp for transferring the thread or threads between the cups after the throwing operation.

Figure 2:
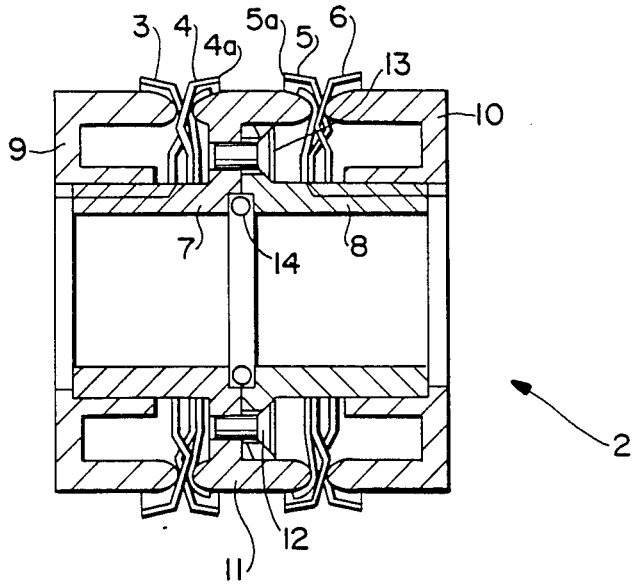
Figure 3:
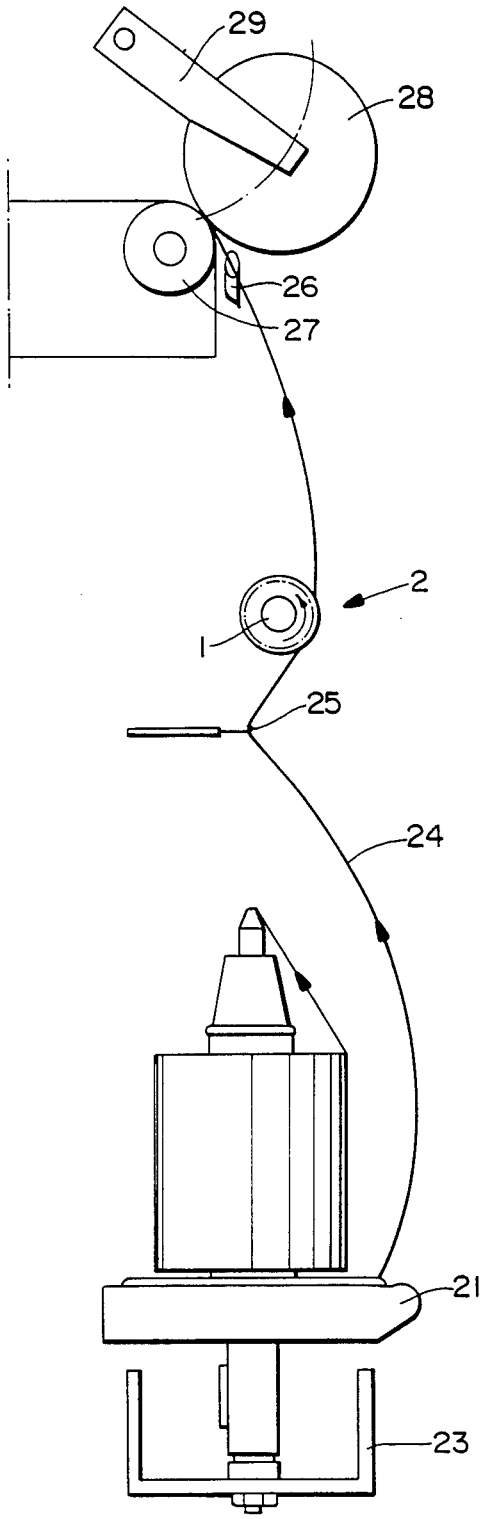
Figure 4:
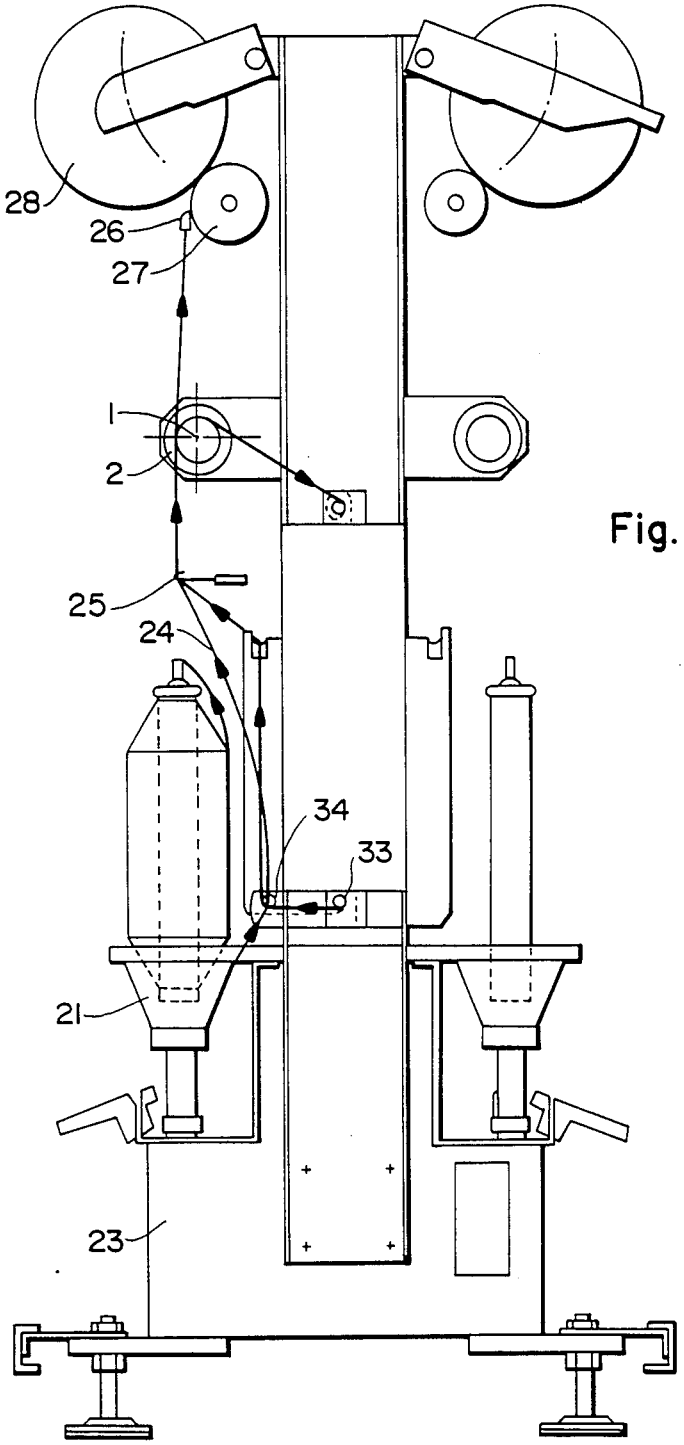

The invention will be more readily understood on reading the following description with reference to the accompanying drawings in which:

FIG. 1 is a cross-sectional view of a first embodiment of the thread slackening device according to the invention, FIG. 2 is a cross-sectional view of a second embodiment of said device;

FIGS. 3 and 4 are side views of two examples of application of such slackening devices, FIG. 3 illustrating the use of a two-for-one twisting machine, the device according to the invention then permitting the treatment of two threads in two adjacent positions and FIG. 4 showing one example of embodiment of such a twisting machine comprising a heat-treatment operation, the slackening device according to the invention then permitting an adjustment of the tension after each phase of treatment (after the twisting operation and after the heat treatment).

Referring first to FIG. 1, this shows that the thread slackening device according to the invention is essentially composed of an assembly mounted in fixed manner on a driving shaft (1). Said assembly, designated as a whole by the reference (2) is constituted by two pairs of cups respectively (3,4) and (5,6) mounted on two hubs (7,8). Each of these pairs of cups constitutes, in known manner, a thread slackening device. Nuts (9,10)

are mounted on the hubs in order to regulate the pressure between the cups (3,4) and (5,6), hence to adjust the tension which is communicated to the thread.

According to the invention, the two sets of cups are mounted on either sides of a circular track (11), which, in the illustrated case, is constituted by a separate part mounted between the two hubs (7,8). Junction of the hubs (7,8) with the track (11) is achieved by means of screws (12,13) and the whole assembly is driven in rotation by the shaft (1) via a joint (14). Thus, as clearly illustrated in FIG. 1, the circular track (11) is smooth, has an external diameter D which is not only greater than the diameter $d_1$ of the circle of contact between the two cups, but also greater than the external diameter $d_2$ of said cups (3,4) and (5,6). On either side of said track (11), are provided two rims (15,16) for keeping the thread on the circular track (11) during the throwing operation.

FIG. 2 illustrates a second embodiment of the device according to the invention, using the same references to designate elements identical or equivalent to those used in the first embodiment described hereinabove.

Compared with the embodiment illustrated in FIG. 1, the central circular track in this second embodiment is formed directly in one of the hubs, (7) in this case, the two hubs (7,8) being likewise assembled together by means of screws (12,13) and mounted on the shaft (not shown) by means of a joint (14). According to this variant, the diameter D of the track (11) is between that of the diameter $d_1$ of the circle of contact between the cups (3,4) or (5,6) and the external diameter $d_2$ of said cups. The rims (4*a*) and (5*a*) of cups (4) and (5) keep the thread on the track (11) during the throwing operation and act as a ramp, thus making it easy to transfer the thread between the cups (3,4) and (5,6) after the throwing and when the threads are placed in the normal working condition.

Such thread slackening devices may be used with all textile materials used in single or double twisting, either for slackening two threads working on two successive positions, or for ensuring two successive slackening operations on the same thread when a plurality of operations are performed continuously, such as for example, a twisting operation followed by a heat treatment, or a twisting operation followed by a false twist operation, etc . . .

The two examples of application shown in FIGS. 3 and 4 illustrate such possibilities, although other applications are possible with said device, for example with installations used only for carrying out shrinkage heat treatments on threads, or with texturing machines using the false twist or other methods and, in general, in all cases where the object is to alter the tension imparted to a thread during a treatment.

In the example of application illustrated in FIG. 3, the slackening device according to the invention is that illustrated in FIG. 1, and designated by the general reference (2), and is mounted on a twisting machine comprising:

a double twist spindle (21) of a type known per se, mounted on the frame (23) of the machine and driven in rotation by any suitable means, such as a belt or an individual motor;

the thread (24) leaving the double twist spindle (21) passes in a pigtail thread guide (25) and then on the slackener (2) according to the invention;

the thread passes around said slackener (2) and is brought to the winding assembly proper, which assembly comprises a traverse guide (26), a drive cylinder (27) and a winding bobbin (28) mounted on a pivoting support (29).

According to the invention, the slackener (2) makes it possible to treat two threads in two adjacent positions, one passing between cups (3) and (4), and the other passing between cups (5) and (6).

During the throwing operation, the two threads in two adjacent positions are placed on the central track (11) provided in such slackener and, when the throwing is completed, the threads are pushed back on the tracks (3,4) and (5,6) in order to be placed in the working condition.

As illustrated in FIG. 4, such a thread slackening device (2) can also be used in the case of a double twist machine in which a heat treatment is conducted after the twisting operation. Such a machine is described in particular in French Pat. No. 2 430 991 and therefore will not be described here in detail.

In comparison with the machine described with reference to FIG. 3, the difference essentially resides in the presence of an oven (32) where the heat treatment is conducted on the thread after the twisting operation. In such a machine, the twisted thread (24) passes into the thread guide (25) then around the slackener (2) according to the invention, before being introduced inside the oven (32). When coming out of the oven, the thread is sent via guides (33,34) towards winding means (26, 27,28). The slackening device (2) is situated above the double twist spindle. The thread leaving said double twist spindle passes on one of the tracks, for example the track formed by cups (3,4), then, after a passage in the oven (32) it is brought in such a way as to pass on a second track (5,6). It is therefore possible with such a device to obtain a slackening of the thread before its passage in the oven and a second slackening after its passage in the oven and before winding. The slackening operations may in fact be adapted by adjusting the pressure exerted by the nuts (9,10) on each of the respective tracks formed by the cups (3,4) and(5,6).

As in the preceding case, when the thread is thrown, it is placed on the central cylindrical track (11), and after the throwing, the spires of thread are pushed back on tracks (3,4) and (5,6) respectively, in order to be placed in the working condition.

Besides the fact that with such a device, the throwing operations are easier, and that it is possible to treat two threads in parallel or to perform two variations of tension on the same thread, said device has the added advantage of being of very simple design, hence of easy maintenance.

Said device may be used in numerous fields of application and in particular with any type of single or double twisting equipment in which the thread will undergo other treatments either simultaneous or continuous to the twisting, such as for example heat treatment, texturing treatment, and even the insertion of a second thread, etc. . .

What is claimed is:

1. A thread slackening device comprising:

a rotary shaft;

a first hub and a second hub carried by said rotary shaft and being rotatable therewith, each of said hubs having an inner end and an outer end, the inner end of said first hub being juxtaposed with the inner end of said second hub;

a cylindrical track located adjacent the inner ends of said first and second hubs and extending around said rotary shaft, said cylindrical track being fixedly secured to at least one of said hubs;

a first nut mounted on the outer end of said first hub and a second nut mounted on the outer end of said second hub, said nuts being axially movable relative to said hubs; and first and second pairs of cups mounted on opposite sides of said cylindrical track, said first pair of cups extending radial outwardly from said first hub, terminating in free outer ends which form a first lateral rim, and being carried by said first hub such that the cups are held in position against one another by said first nut to form a first side track, and said second pair of cups extending radially outwardly from said second hub, terminating in free outer ends which form a second lateral rim, and being carried by said second hub such that the cups are held in position against one another by said second nut to form a second side track;

wherein an external diameter of said cylindrical track is at least equal to a diameter of said first side track and at least equal to a diameter of said second side track;

wherein tension communicated to a thread passing between either of said pairs of cup can be varied by axially moving the respective nut to change the pressure exerted upon the cups; and wherein the thread is in contact with said cylindrical track during a throwing operation and is pushed back onto one of said side tracks after being thrown.

2. The thread slackening device of claim 1, wherein said cylindrical track comprises a separate part interposed between said hubs, which separate part is secured to at least one of said hubs by a screw, and wherein said cylindrical track is provided with two peripheral flanges for supporting the thread on the cylindrical track during the throwing operation.

3. The thread slackening device of claim 2 wherein the external diameter of said cylindrical track is greater than a diameter of said first lateral rim and is greater than a diameter of said second lateral rim.

4. The thread slackening device of claim 1, wherein said cylindrical track is integrally formed with one of said hubs, and wherein the external diameter of said cylindrical track is less than a diameter of the first lateral rim and less than a diameter of the second lateral rim.

* * * * *